US005954066A

United States Patent [19]

Carlsson et al.

[11] Patent Number: 5,954,066

[45] **Date of Patent: *Sep. 21, 1999**

[54] METHOD FOR CONTROLLING CHEMICAL REACTION

[75] Inventors: Torbjörn Carlsson, Långserud; Lennart Gustavsson, Karlstad, both of Sweden

[73] Assignee: Kvaerner Pulping AB, Karlstad, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/024,423

[22] Filed: Feb. 17, 1998

Related U.S. Application Data

[62] Division of application No. 08/378,009, Jan. 25, 1995, Pat. No. 5,858,170.

[51] Int. Cl.[6] ..... D21C 9/16; B08B 9/00; B08B 9/02

[52] U.S. Cl. ..... 134/22.1; 134/22.11; 137/15; 162/48; 162/78; 422/117

[58] Field of Search ..... 162/44, 48, 52, 162/63, 65, 78, 199, 243, 238, 246, 252; 210/761; 137/118 R, 15; 237/7; 134/22.1, 22.11; 422/117

[56] References Cited

U.S. PATENT DOCUMENTS

| | | | |
|---|---|---|---|
| 1,433,865 | 10/1922 | Wolf . | |
| 1,576,018 | 3/1926 | Wolf | 162/65 |
| 1,643,566 | 9/1927 | Thorne | 162/65 |
| 3,622,441 | 11/1971 | Perkins | 162/246 |
| 3,719,552 | 3/1973 | Farley et al. | 162/65 |
| 3,964,962 | 6/1976 | Carlsmith | 162/246 |
| 3,992,248 | 11/1976 | Hurter | 162/238 |
| 4,158,597 | 6/1979 | Petterson | 162/238 |
| 4,161,421 | 7/1979 | Sherman | 162/65 |
| 4,177,105 | 12/1979 | Laasko et al. | 162/65 |
| 4,432,836 | 2/1984 | Sherman et al. | 162/243 |
| 5,100,560 | 3/1992 | Huang | 210/761 |
| 5,364,505 | 11/1994 | Funk et al. | 162/238 |
| 5,571,377 | 11/1996 | Tibbing et al. | 162/65 |
| 5,858,170 | 1/1999 | Carlsson et al. | 162/63 |

*Primary Examiner*—Joseph W. Drodge
*Attorney, Agent, or Firm*—Dorsey & Whitney LLP

[57] ABSTRACT

Method for safely carrying out chemical reactions in a vessel having a discharge end, wherein a control valve is provided at the discharge end, and wherein reacted and unreacted chemicals are cleared from in front of the control valve thus reducing the risk of reacted and unreacted chemicals blocking the discharge end of the vessel.

7 Claims, 2 Drawing Sheets

METHOD FOR CONTROLLING CHEMICAL REACTION

CROSS REFERENCE TO RELATED APPLICATION

This application is a division of application Ser. No. 08/378,009 filed Jan. 25, 1995, now U.S. Pat. No. 5,858,170.

FIELD OF THE INVENTION

The present invention relates to a method for pressurized peroxide bleaching and, more specifically, to a method for carrying out pressurized peroxide bleaching safely, i.e. to a method in association with pressurized peroxide bleaching which is intended to eliminate possible risks of injury to personnel or of damage of a mechanical nature.

DESCRIPTION OF THE RELATED ART

Our own patent SE-C-500616 has previously disclosed a method for carrying out pressurized peroxide bleaching of pulp at a consistency exceeding 8%, in a bleaching vessel designed for pressures greater than atmospheric pressure, with the pulp being fed to the vessel by means of a pump and heated to a temperature exceeding 90° C. and being bleached with peroxide using a quantity exceeding 5 kg/BDMT.

As the peroxide decomposes, oxygen gas is formed. If the discharge from an above-described bleaching vessel is suddenly halted, the pressure in the reactor will increase gradually due to decomposition of the peroxide and the formation of oxygen gas. The risk therefore exists that a bleaching vessel of this type, or surrounding equipment, could reach, once the stoppage has continued for a period of time, a pressure which exceeds its permitted pressure limit.

SUMMARY OF THE INVENTION

An object of the present invention is to create a safety system which eliminates the risk of reaching the above-mentioned forbidden pressure limit within the vessel or any part of its surrounding equipment. Due to the nature of the milieu, i.e., a fibre-containing suspension, such a system cannot be secured using mechanical safety valves since, once such a valve has been used once fibres will inevitably have become located between the cone and the seat, resulting in malfunction.

The object of the present invention is achieved using a method wherein, upon plugging or power failure, measures are taken, essentially without using mechanical safety valves, which prevent the pressure in the bleaching vessel, or an affiliated part, from exceeding a certain set point.

A further aspect of the invention is that the pump (2) which feeds pulp to the bleaching vessel is shut off when the pressure in the bleaching vessel exceeds a desired first set point, preferably approximately 0.55 MPa overpressure, ±0.05 MPa.

A further aspect of the invention is a bypass conduit which links the pump (2) to the bleaching vessel (1) and which is opened by means of a valve (H) when the pump (2) stops.

A further aspect of the invention is that the pulp is heated in a mixer (3) arranged between the pump (2) and the bleaching vessel (1) and that the supply of steam, by means of a valve (B), and also the supply of other possible fluids, such as oxygen gas, to the mixer (3) is interrupted when the pressure in the bleaching vessel exceeds a desired first set point, preferably 0.55 MPa overpressure ±0.05 MPa.

A further aspect of the invention is that a safety valve (A) opens a connection to a lower pressure, preferably atmospheric pressure, for a pipe conduit which runs between the valve (B), at the mixer (3), and the valves (E) and (D) when the pressure in the reactor exceeds a desired set point, preferably approximately 0.05 MPa higher than the said first set point.

A further aspect of the invention is that a valve (C), which is arranged at the discharge end of the bleaching vessel (1), opens a second connection to an outlet pipe (4) from the vessel (1) when the pressure in the vessel (1) exceeds a certain third set point, preferably about 0.1 MPa greater than the said first set point, which valve (C) preferably shuts again when the pressure falls back below the said set point.

A further aspect of the invention is that the bleaching vessel (1) is arranged with a discharge scraper (5) and that the said valve (C) is arranged, preferably directly on the vessel (1) without any space in between, so that the scraper (5) cleans in front of this valve (C), thereby eliminating the risk of a pulp plug being formed.

A further aspect of the invention is that the distance between the valve cone and the outer edge of the scraper is less than 300 mm, preferably 200 mm, and more preferably 100 mm.

A further aspect of the invention is that the bleaching vessel (1) is equipped with a rupture disc (9) which opens towards lower pressure at a pressure inside the vessel which exceeds the said first set point, preferably by 0.15 MPa overpressure.

A further aspect of the invention is that the outlet conduit (4) leads to a standpipe (6) which is arranged with a spillway (7) which preferably opens out in an area which is at least in part enclosed by a wall (8) which is impervious to liquid.

BRIEF DESCRIPTION OF THE FIGURES

The invention will be elucidated in more detail below with reference to the attached figures in which.

DESCRIPTION OF THE PREFERRED EMBODIMENTS

Figure 1:
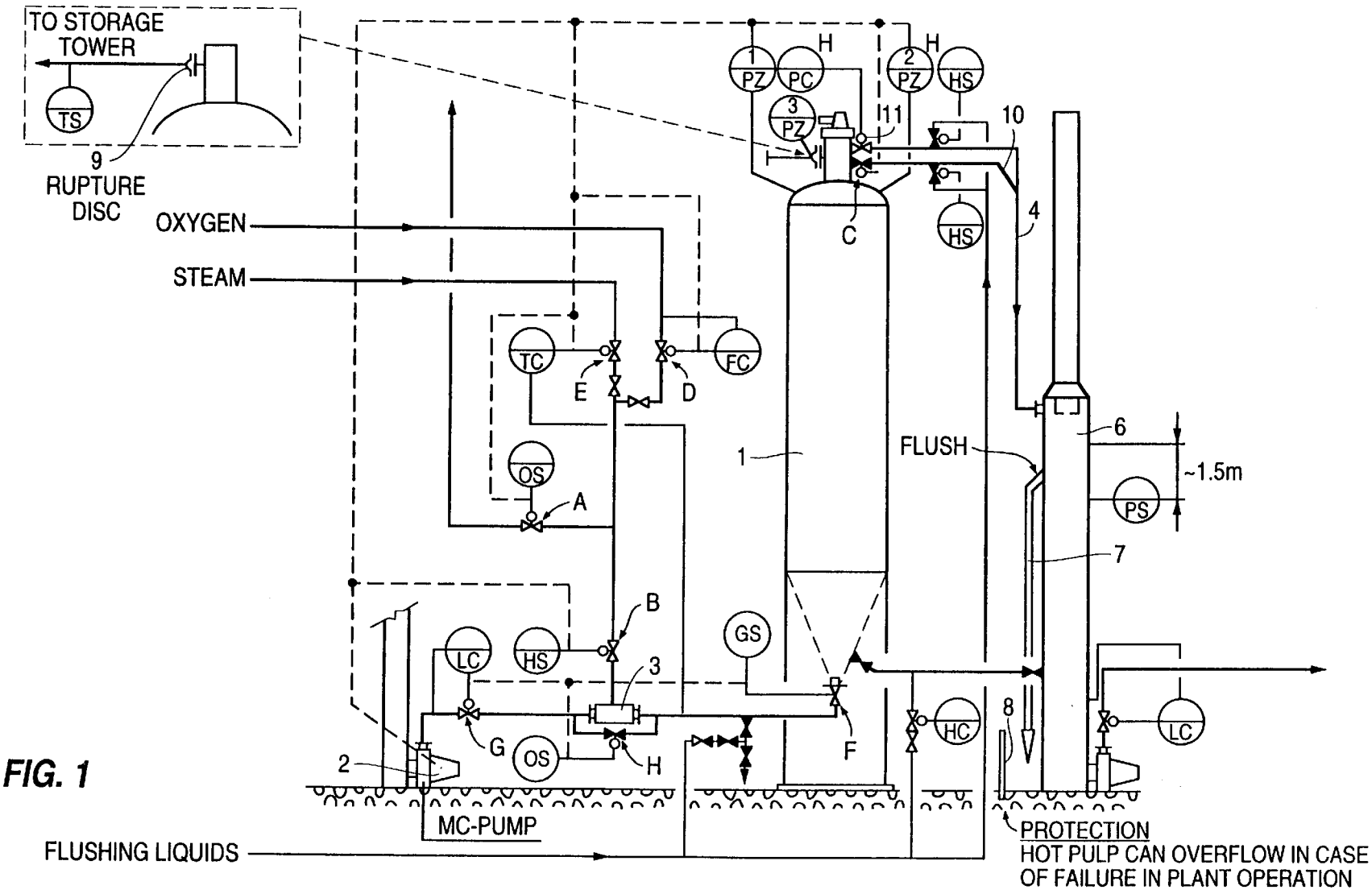
FIG. 1 shows a preferred embodiment for arranging a safety system in association with a pressurized peroxide bleaching vessel.

FIG. 1 accordingly shows a preferred embodiment of a system according to the invention. A pressurized peroxide vessel (1), which is filled hydraulically, normally operates at a pressure, half-way up the vessel, of about 3–5 bar. The pressure is maintained with the aid of a medium-consistency pump (2) which thus feeds the pulp to the bleaching vessel (1). Between the pump (2) and the bleaching vessel (1) there is a mixer (3) which, in order to raise the temperature of the pulp, is fed with steam, preferably mediumpressure steam, so that the temperature of the pulp in the preferred case exceeds 100° C. In certain cases (for example, in order to increase the pressure or to prevent so-called "condensate bangs"), it is desirable also to supply oxygen gas to the mixer (3). The peroxide is preferably supplied to the pulp either prior to or at the pump (2). Very effective bleaching of the pulp is achieved due to the high temperature and the high pressure in the reactor.

The pulp is discharged, using a scraper (5) (see FIG. 2), from the top of the vessel (1) and is conveyed via a conduit (4) to a so-called standpipe (6) in which the pulp is "degassed". The standpipe (6) is additionally arranged with a spillway (7) which opens to an area which is at least in part enclosed by a wall (8) which is impervious to liquid.

In order to operate this reactor safely, there are arranged a number of valves etc., the most important functions of which are given below. Between the pump (2) and the mixer (3) there is a shutoff valve (G) which is normally open. A valve (H), which is normally closed, is arranged in a bypass conduit which circumvents the mixer (3). One (or two) valve(s) (B), which is/are normally open, is/are arranged in the main conduit for supplying steam and oxygen gas. That side of the valve (B) which is not in contact with the mixer side can be brought into contact with atmospheric pressure by opening valve (A), which is normally closed. In addition, valves (E) and (D) are present for regulating the flow of steam and of oxygen gas, respectively. A valve (F), which can be shut off manually, is arranged at the bottom of the reactor. An additional conduit (10) is arranged at the top of the reactor, which conduit links the top of the reactor with the outlet pipe (4) when a valve (C) opens. In addition, two pressure sensors (1, PZ) and (2, PZ) are arranged at the top of the reactor. In cases where it is desired, a "rupture disc" (9) is also arranged at the top of the reactor.

According to the preferred embodiment, the reactor is constructed for a maximum pressure of 0.7 MPa overpressure at the top at a temperature of 180° C. The preferred safety system functions as follows. At a first set point, 0.55 MPa overpressure, which is thus then measured by one of the independent pressure sensors, the MC pump is stopped, and the valves for the supply of steam and, where appropriate, oxygen gas, (E) and (D), respectively, are closed, as is the valve (B) as well. This therefore ensures that no additional oxygen or steam will be supplied to the mixer (3). The valve (B) is equipped with a spring for closing the valve.

At a second set point, 0.6 MPa overpressure, the valve (A) opens so that the volume in the pipe between the regulating valves for oxygen gas and steam and the valve (B) can be ventilated. The valve (A) is equipped with a spring in order to open.

At a third pressure level, 0.65 MPa overpressure, the valve (C) at the top of the reactor opens fully, thereby connecting this additional conduit (10) to the outlet pipe (4). The valve (C) is arranged with a spring for the opening function.

If the electricity supply were completely cut off, and if there were no reserve system, such as, for example, air, the safety valve (C) would open and pulp would flow out in an unregulated manner if no preventive measures were taken. In order to avoid this happening, the safety valve (C) can be connected to a prioritized electrical circuit and/or to an auxiliary system, for example an air system. If there is no such auxiliary system, the valve can be connected to an air tank having a nonreturn valve. This tank must be able to accommodate the volume which is required for ensuring at least ten actuations of the valve (C). The solenoid which acts on the safety valve can be operated by the power back-up system for the instrumentation.

It is important that the connecting conduit in which the valve (C) is located is made as short as possible in order to avoid a drop in pressure.

In certain cases, as has already been mentioned, the reactor is arranged with a rupture disc, which preferably has a rupture value of 0.7 MPa. A temperature sensor is preferably installed in the pipe downstream of the rupture disc, which sensor can be used to indicate that the disc is ruptured which stops the pump (2).

According to a preferred embodiment, a position sensor is present which senses whether the manual valve (F) is shut or being shut and which then shuts off the pump (2).

Figure 2:
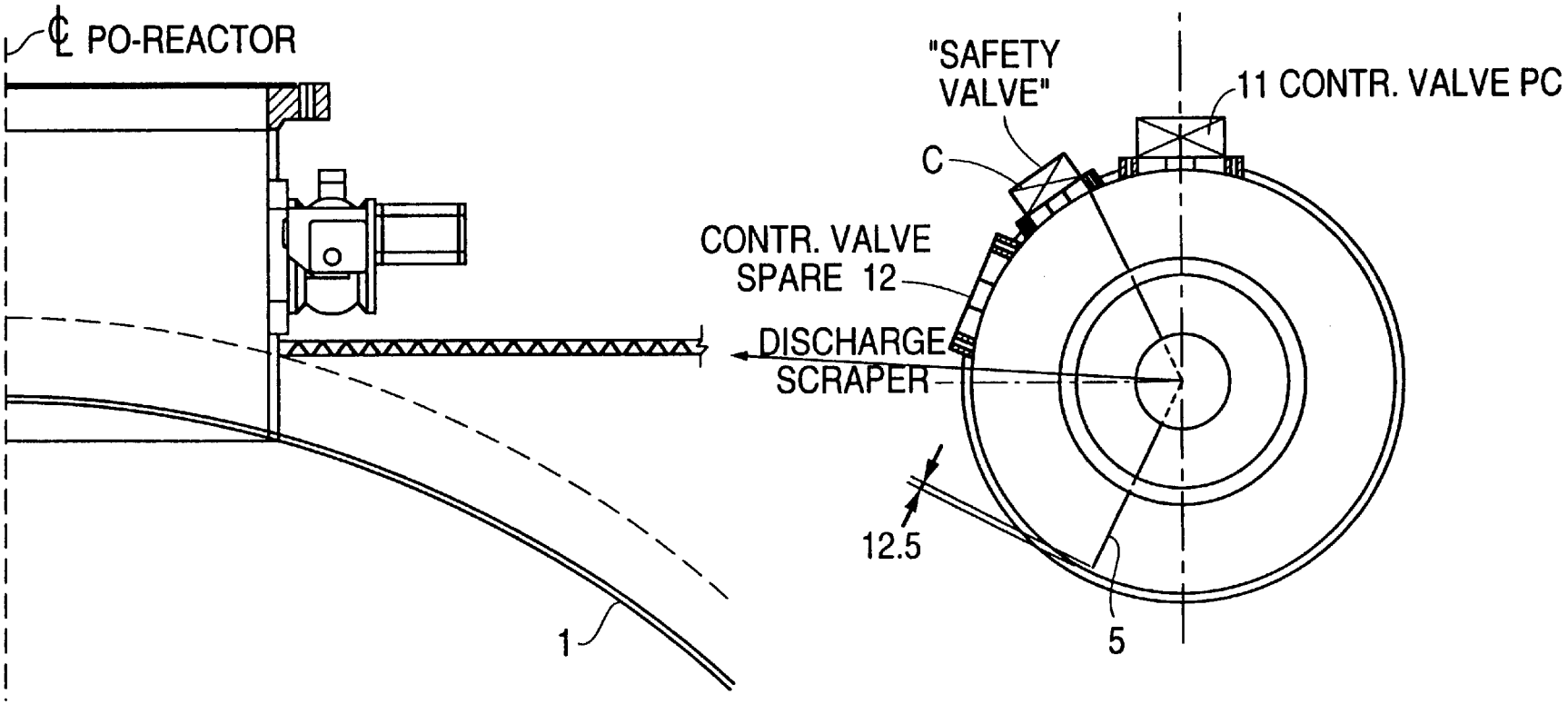
FIG. 2 shows a preferred detailed embodiment for the discharge end of such a vessel.

FIG. 2 shows that the different valves (the outflow control valve 11, the emergency valve C and the additional flange 12) are arranged so that the discharge scraper (5) cleans in front of these valves as it rotates. To avoid the possibility of pulp plugs building up, the valves are arranged directly on the vessel. According to a preferred embodiment, the distance between valve cone and scraper end must not exceed 200 mm and the outer edge of the scraper blade should be shaped so that it sweeps past the whole of the inlet to each opening which leads to a valve or the like.

What is claimed is:

1. A method for safely carrying out a chemical reaction in a vessel having a discharge end, comprising the steps of:

introducing chemicals into the vessel;

positioning a control valve in a conduit exteriorly of said vessel, said conduit opening to said vessel;

connecting said control valve to the discharge end of said vessel for controlling the discharge from said vessel; and clearing chemicals from the opening to said conduit in front of the control valve, for eliminating the risk of chemicals from blocking the discharge end of said vessel.

2. The method according to claim 1, wherein said chemical reaction is pressurized peroxide bleaching of pulp.

3. The method of claim 1 wherein a discharge scraper is provided in said vessel, the method further comprising:

moving said discharge scraper for clearing the front of said control valve.

4. The method of claim 3 wherein the distance between the scraper and the control valve is about 200 mm.

5. The method of claim 1, wherein the control valve includes a movable cone and said step of clearing includes clearing between said vessel discharge end and said cone.

6. The method of claim 1 including the step of discharging from the upper end of said vessel.

7. The method of claim 1 wherein the length of the conduit between the vessel and the control valve is about 200 mm.

* * * * *